United States Patent [19]

Klette

[11] 4,020,529

[45] May 3, 1977

[54] UNFASTENING BUTTON, PARTICULARLY FOR UPHOLSTERY

[75] Inventor: Güenter Klette, Schwelm, Germany

[73] Assignee: Firma Astor-Werk Otto Berning & Co., Schweim, Germany

[22] Filed: June 9, 1975

[21] Appl. No.: 585,131

[30] Foreign Application Priority Data

June 7, 1974 Germany ..... 2427456

[52] U.S. Cl. ..... 24/90 TB

[51] Int. Cl.[2] ..... A44B 1/18

[58] Field of Search ..... 24/102 T, 90 TB; 5/356

[56] References Cited

UNITED STATES PATENTS

| | | | |
|---|---|---|---|
| 962,242 | 6/1910 | Reeside | 24/90 R |
| 1,627,723 | 5/1927 | Bebry | 5/356 |
| 1,845,762 | 2/1932 | Newton | 24/90 B |

FOREIGN PATENTS OR APPLICATIONS

| | | | |
|---|---|---|---|
| 1,214,567 | 11/1959 | France | 24/90 TB |

*Primary Examiner*—Werner H. Schroeder
*Assistant Examiner*—Doris L. Troutman
*Attorney, Agent, or Firm*—Martin A. Farber

[57] ABSTRACT

An unfastening button, particularly for upholstery comprising a button having a bottom part, and a hook extending from the bottom part and having a closing mouth for insertion therein of a loop end of an unfastening thread, the mouth of the hook closing by means of a part surface section of the bottom part.

8 Claims, 7 Drawing Figures

17
II
15
10
14
13
9
11
III
8
III
x
4
3
7
16
6
1
2
II 10
14
13
11
3
12
2
5
1
12

12
11

7
5
6
8
11
12

UNFASTENING BUTTON, PARTICULARLY FOR UPHOLSTERY

The present invention relates to an unfastening button, particularly for upholstery goods, comprising a hook which starts from the lower side of the button and having a locking mouth, for insertion of the loop end of the unfastening or release thread.

It is known to make the unfastening button of synthetic material and to form the mouth of the hook in the manner of a snap or spring hook. By the spring hook formed construction, however, the corresponding section of the hook mouth has a not unusual weakening, which is detrimental to a durable securing of the unfastening button. Difficulties then arise with such a construction to introduce yet relatively thick loop ends in the mouth of the hook, since then a large yieldability of the spring web of the hook mouth must be provided. A further disadvantage resides that, with the unfastening button manufactured in an injection moulding type process, as a consequence of the partition line of the injection mould, after the moulding there often occurs a projecting ridge at the hook mouth, which leads to a premature tearing or rubbing through of the loop end of the unfastening thread.

Also, unfastening buttons are known by which a shaft made of wire material extends from its lower side, which shaft end sidedly forms the hook mouth. This hook mouth is hooked and fixed on the spring windings of the wire spring of the core. Such a construction is suited however only with upholstery goods which are equipped with spring cores. With other upholstery articles which are provided with foam material fillings, or the like, the long hook shafts lead to disadvantages in the quality of service.

It is an object of the present invention, in particular, that is, in addition to the objectives resulting from the specification and claims, to provide a generic type unfastening button of favorable service and commercially simple construction of the kind such that on one hand the assembling of the unfastening button is facilitated and on the other hand a high stability of use exists.

This object and task is solved in accordance with the present invention by providing an unfastening button of the introductory mention type wherein the locking of the hook mouth is achieved by a part of the surface section of the lower side of the button.

Other objects of the present invention are to provide other advantageous constructions in accordance with the features set forth in the dependent claims.

As a result of such constructions of the present invention there is produced a generic type unfastening button of increased service value. The unfastening button can be produced economically due to its simple construction. The hook forming the mouth no longer needs to be formed as a snap or spring locking hook. The hook can moreover retain equal cross-section over its entire length. In particular, round material made of metal is suitable for the hooks, so that as a result of the then existing smooth surface, a rubbing away of the loop end of the unfastening thread is prevented. The hook mouth becomes closed by a partial surface section of the lower side of the button, which permits a simple form of the hook. This brings advantages with the production of the tools forming the hook. The resilient yieldability during the insertion of the loop end in the hook mouth can result either from the hook, the partial surface section of the lower side of the hook, or from both of these previously named parts. After the insertion of the loop end in the mouth of the hook, the partial surface section and the hook step in their position closing the mouth, which guarantees a reliable locking or shackling of the loop end of the unfastening thread. This locking position does not permit an unintentional release. For this purpose a decisive intentional operation is required. It is suggested to assemble the hook and button part in the path of the stick-in connection, which provides a large variation possibility with respect to the coordination of the button part to the hook. If the hook is constructed relatively stiff, the springing resiliency of the partial surface section of the lower side of the button can be achieved by the freely cut tongue. During insertion of the loop end, the freely cut tongue is positively displaced and mechanically controlled by this loop end, the tongue, however, after the complete hooking, stepping back again in the engagement position to the hook end by closing of the hook mouth. An especially secure closing position is brought about by the tongue, the free end of which projects in the mouth of the hook. The loop can also not be drawn out of the hook mouth with relatively large exertion of force with such a construction, since the tongue acts grapplehook like. A drawing out is only possible if the free end of the of the hook is supported or proped in opposition to the direction of the lower side of the button.

The free cut tongues run off center yet to the free hook ends such that a disturbance-free passing through of the loop end is provided, that is, the hook end and tongue form an insertion wedge key. If a free cut tongue is waived for certain purposes of use, the insertion wedge key can be formed in a simple manner by the upwardly bent section of the free end of the hook. It further offers the possibility to bring such a hook construction in service also in connection with a freely cut tongue, which construction then is suited for relatively thick loop material. The construction according to the invention permits beyond that, a plurality of variations, whereby a large adaptation to the respective application purpose may be achieved.

With the above and other objects in view the invention will become apparent in connection with the detailed description of preferred embodiments thereof in connection with the accompanying drawings, of which:

Figure 1:
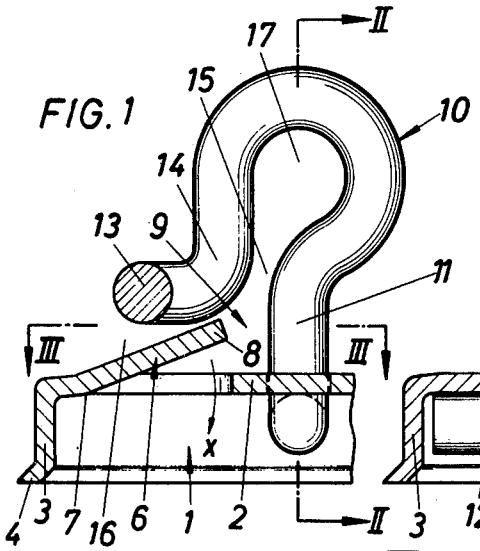
FIG. 1 is a partial longitudinal section through an unfastening button in accordance with a first embodiment of the present invention.
Figure 2:
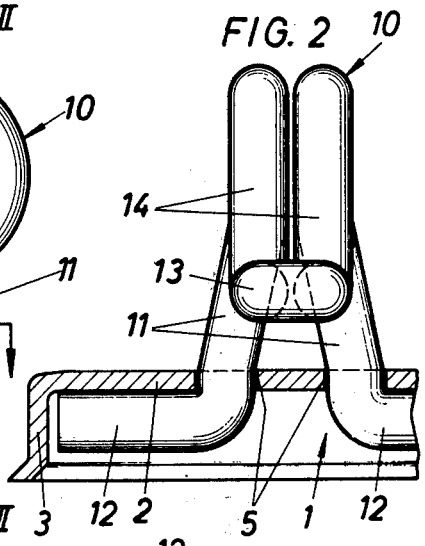
FIG. 2 is a section taken along the lines II—II of FIG. 1.
Figure 3:
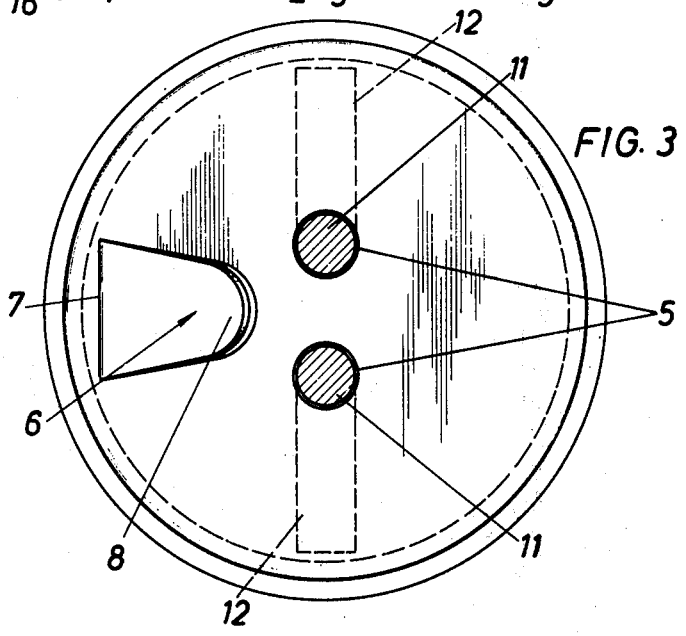
FIG. 3 is a section taken along the lines III—III of FIG. 1.

Referring now to the drawings, and more particularly to FIGS. 1—3, an unfastening button in accordance with the present invention comprises a button plate 1 which is pot-shaped in cross-section and which is formed as an assembly button lower part in the embodiment example. The button plate 1 comprises also the lower side or bottom part 2 of the button and the pot edge 3, the latter having an outwardly bent extremity 4.

Two insertion openings 5 as well as a free cut tongue 6 are located in the lower side 2 of the button. The tongue is pivotable about its bend zone 7 and projects over the lower side 2 of the button. The free end 8 of the tongue 6 projects in the hook mouth 9 of the hook 10, the latter starting out from the lower side 2 of the button.

The hook 10 is made of metallic round material. This hook is a double hook, the hook shafts 11 of which are inserted through the insertion holes 5 and are bent radially outwardly inside the button plate 1. The bent ends 12 are supported on the inner wall of the lower side 2 of the button. The free end 14 of the hook continues in a section 13 which is bent in a parallel direction relative to the lower side 2 of the button. The section 13 lies in the immediate vicinity of the tongue 6, the latter projecting into the mouth 9 of the hook. The curving bend extending between the section 13 and the hook end 14 in connection with the opposite section of the hook shaft 11 forms a constriction 15 inside of the mouth 9 of the hook.

The tongue 6 which rises in a direction of the center axis of the button plate 1, in connection with the section 13 forms an insertion wedge key 16 for the cooperating loop (not illustrated).

If the loop is placed in the hook mouth 9, the tongue 6 is for the time being swung downwardly in the direction of the arrow *x* by the loop entering in the insertion wedge key 16. Thereafter the loop enters in the mouth 9 of the hook and passes through the constriction 15 thereof, whereby the hook itself is somewhat spread. Subsequently the loop enters in the insert opening 17 of the mouth 9 of the hook. The loop then no longer can inadvertently be removed from the mouth of the hook, since the free end 8 of tongue 6 acts barbed- or grapple-hook like. The hook itself can spring back upwardly due to its springiness.

Figure 4:
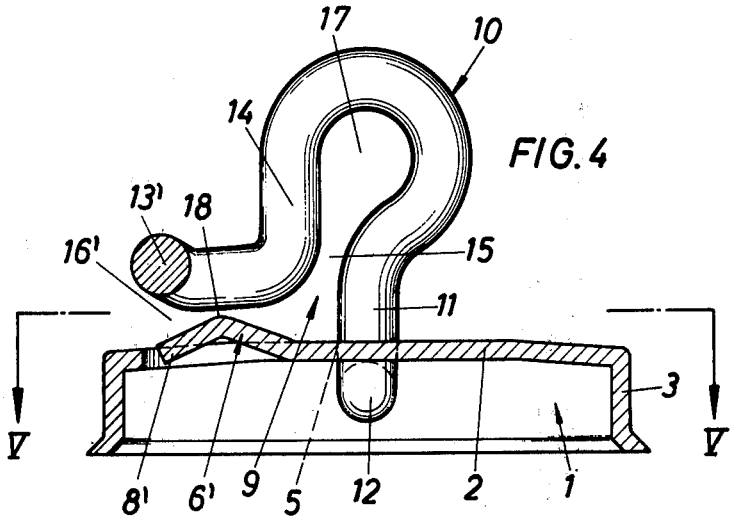
FIG. 4 is a longitudinal cross-sectional view through an unfastening button in accordance with a second embodiment of the invention.
Figure 5:
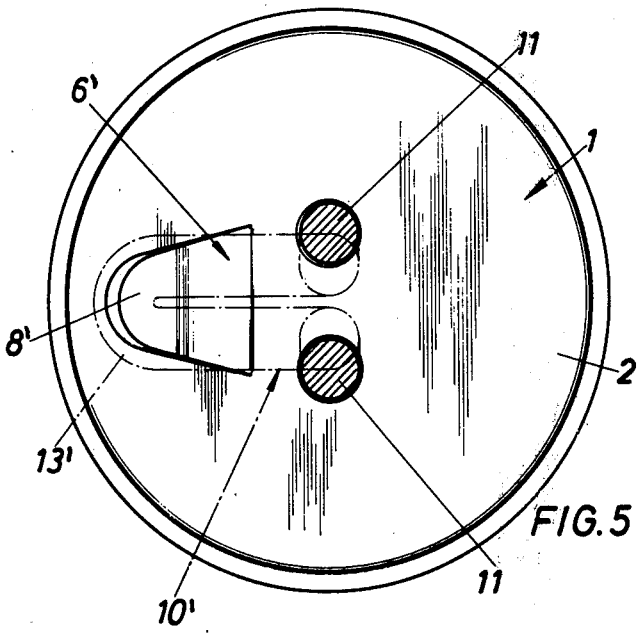
FIG. 5 is a section taken along the lines V—V of FIG. 4.

According to the second embodiment example the hook is similarly executed, as illustrated in FIGS. 4 and 5. However, the tongue 6' which projects from the lower side 2 of the button is formed differently. It has a tongue which in cross-section is profiled in the form of a roof (herein defined as an upside down V-shape), the free end 8' of the tongue lying radially outwardly directed. The peak or apex 18 of the tongue extends substantially up to the section 13' of the hook 10. The latter section is connected in an upward direction to the section of the hook which lies parallel to the lower side 2 of the button. In this manner, the insertion wedge key 16' is formed between the free end 8' of the tongue and the free end 13'.

With both of the previously described embodiment examples of the invention, material with springy or resilient characteristics find use for the button plate 1.

Figure 6:
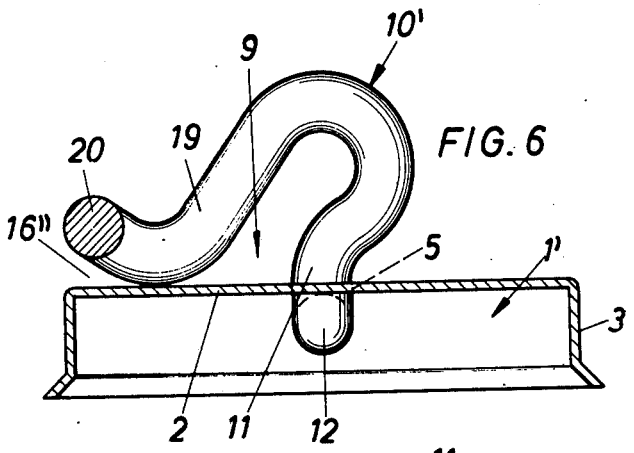
FIG. 6 is a longitudinal cross-sectional view through an unfastening button in accordance with a third embodiment of the invention.
Figure 7:
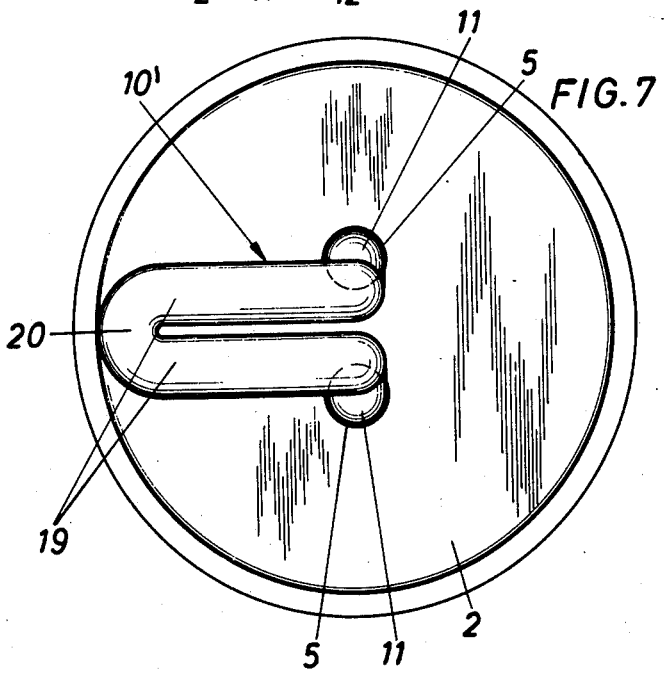
FIG. 7 is a plan view of FIG. 6.

Referring now again to the drawings, and more particularly to FIGS. 6 and 7, a third embodiment example of the invention is illustrated, by which the springing resiliency results exclusively from the hook 10'. The button plate 1' has the insertion holes 5' on its lower side, the holes 5' serving for the securing or chaining of the hook 10'.

The free end 19 of the hook projects onto the lower side 2 of the bottom and extends following thereon in an upwardly bent section 20. The latter together with the lower side of the button forms the insertion wedge key 16''. As a consequence of this construction, the free end 19 of the hook possesses an increased springing travel, which permits the loop to be inserted in the mouth 9 of the hook.

With all embodiment forms, the mouth 9 of the hook is closed by a partial surface section of the lower side i.e., the bottom part of the button. According to FIGS. 1 – 5, this partial surface section is formed by the freely cut tongues, whereas by the third embodiment, it is formed by a corresponding section of the lower 2 side 2 of the button.

Further, it is to be noted that other cooperative structural spatial arrangements shown in the drawings constitute features of the invention which provide the advantageous operation of the unfastening hook of the invention. For example, although not limited thereto, in FIGS. 1 and 2, the vertical downward depending parallel end arms 14 extend by a parallel arm curving bend into the horizontal parallel arm portion which in turn runs into the extremity 13 or 13', respectively. Cooperatively, the free end 8 of the tongue 6 in the closed position lies adjacent the curving bend above the lowermost portion of the horizontal arm portion, and substantially tangential thereto. The apex 18 of the tongue 6' extends to substantially the center of the lowermost portion of the horizontal arm portion of the hook. The shafts 11 extend from the lower side 2 in a narrowing upside down V shape and then continue into the hook end in a spaced but substantially abutting parallel orientation. The tongues are oriented longitudinally parallel to the horizontal arm portion of the hook and have a width substantially equal to that of the parallel arms, the operative free end 8 and apex 18 of the tongues being the closing end of a narrowing section of the tongues and extending substantially crosswise to at least substantially the entire width of the parallel hook end portions. Preferably the tongues have a widest portion larger than the width of the parallel arms of the hook end, narrowing to the free end 8 and apex 18, respectively, at which portions they are slightly narrower than the entire width of the arms. Yet further, the tongues are longitudinally directed perpendicularly to the outwardly extending aligned bent connecting ends 12. As in FIG. 6, the hook end is formed with a long inclined parallel arm portion 19 which extends onto the lower side 2.

While I have shown several embodiments of the invention, these embodiments are given by example only and not in a limiting sense.

I claim:

1. An unfastening button, particularly for upholstery, comprising a button having a substantially planar bottom part, a hook extending from said planar bottom part and defining a locking mouth having an outermost mouth portion for insertion of a loop end of an unfastening thread therethrough and an innermost mouth portion, means for locking said mouth of said hook, said means comprising a part of a surface section of said planar bottom part, said part of said surface section of said planar bottom part of said button constitutes a tongue, said hook has a free end portion communicating with said mouth, said tongue in a longitudinal direction thereof has an inverted substantially V-shaped profile with an apex adjacent to said free end portion, said free end portion extending in said longitudinal direction.

2. The unfastening button as in claim 1, wherein said bottom part is formed with insertion openings along a diameter of said bottom part and centrally spaced on both sides of a center thereof, said hook includes two substantially parallel wire legs forming shafts of said hook, and said legs are inserted in said insertion openings, respectively.

3. The unfastening button as in claim 2, wherein said shafts converge towards each other in a direction extending away from said bottom part and form a curving hook end continuing therefrom and said free end portion, said shafts at said free end portion substantially abutting yet spaced parallel to each other, said free end portion having a U-shaped connected extremity.

4. The unfastening button as in claim 1, wherein said apex is oppositely adjacent a portion of said free end portion, the latter disposed substantially parallel to the planar bottom part of said button.

5. The unfastening button as in claim 4, wherein said apex is opposite a center of said free end portion.

6. An unfastening button, particularly for upholstery, comprising a button having a substantially closed planar bottom part, a hook extending from said bottom part and defining a locking mouth for insertion therein of a loop end of an unfastening thread, means for locking said mouth of said hook, said means comprising a part of a surface section of said bottom part, said part of said surface section of said planar bottom part of said button integrally constitutes a tongue, said hook has a free end portion, the latter having an extremity section communicating with said mouth, said tongue in a longitudinal direction thereof has an inverted V-shaped profile with an apex pointing oppositely adjacent to said free end portion, said free end portion extends in said longitudinal direction and said free end portion is disposed substantially parallel to said planar bottom part of said button, said extremity section of said free end portion is inclined upwardly away relative to said planar bottom part and said tongue includes a downwardly inclined portion relative to said apex extending opposite to said extremity section of said free end portion so as to form an insertion wedge key opening narrowing in a direction toward said apex.

7. The unfastening button as in claim 6, wherein said tongue includes a first upwardly inclined portion integrally connected with said planar bottom part at a widest portion of said tongue, said widest portion is wider than the width of said free end portion, and said apex is narrower that the width of said free end portion, said tongue narrowing therefrom toward a free end thereof, the latter being disposed substantially in the plane of said planar bottom part.

8. The unfastening button as in claim 1, wherein said tongue is integrally joined with said planar bottom part adjacent said innermost mouth portion.

* * * * *

UNITED STATES PATENT AND TRADEMARK OFFICE

CERTIFICATE OF CORRECTION

PATENT NO. : 4,020,529

DATED : May 3, 1977

INVENTOR(S) : Günter Klette

It is certified that error appears in the above-identified patent and that said Letters Patent are hereby corrected as shown below:

Item 75: first name of inventor should be --Günter--

Item 73: city in assignee's address should be --Schwelm--

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*